US008453557B2

(12) United States Patent
Wilton et al.

(10) Patent No.: US 8,453,557 B2
(45) Date of Patent: Jun. 4, 2013

(54) PISTON ACTUATOR ASSEMBLY

(75) Inventors: Daryl A. Wilton, Macomb, MI (US); Bret M. Olson, Whitelake, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 949 days.

(21) Appl. No.: 12/549,517

(22) Filed: Aug. 28, 2009

(65) Prior Publication Data

US 2011/0048222 A1 Mar. 3, 2011

(51) Int. Cl.
*F15B 15/20* (2006.01)

(52) U.S. Cl.
USPC ..... 92/165 R; 92/168

(58) Field of Classification Search
USPC ..... 92/13.6, 165 R, 166, 168; 91/19, 91/281
See application file for complete search history.

(56) References Cited

U.S. PATENT DOCUMENTS

| | | | | | |
|---|---|---|---|---|---|
| 787,480 | A * | 4/1905 | Tanner | 92/62 |
| 3,673,926 | A * | 7/1972 | Mohri | 92/51 |
| 3,791,262 | A * | 2/1974 | Staehlin et al. | 92/52 |
| 4,773,300 | A * | 9/1988 | Klatt et al. | 91/169 |
| 5,067,323 | A * | 11/1991 | Bennett et al. | 60/734 |
| 5,782,162 | A * | 7/1998 | Lanteigne et al. | 92/168 |
| 5,992,267 | A * | 11/1999 | Smith et al. | 74/745 |
| 6,257,117 | B1 * | 7/2001 | Yagishita | 91/169 |
| 6,408,740 | B1 * | 6/2002 | Holt et al. | 92/13.1 |
| 2006/0124607 | A1 * | 6/2006 | Tenzer | 219/89 |

* cited by examiner

*Primary Examiner* — Thomas E Lazo

(57) ABSTRACT

A piston actuator assembly having includes a piston liner slidably disposed within a housing. A piston is slidably disposed within the piston liner and partially slidably disposed in the valve body. A plurality of pressurized fluid passages communicate with the piston actuator assembly and provide a first flow of hydraulic fluid and a second flow of hydraulic fluid. A plurality of seals maintains separate fluid pressure chambers selectively pressurized to achieve a plurality of actuator positions. A plurality of exhaust passages communicate with the piston actuator assembly providing pressure relief to allow for predictive movement of the piston and piston liner.

20 Claims, 6 Drawing Sheets

PISTON ACTUATOR ASSEMBLY

FIELD

The present invention relates generally to linear hydraulic actuators for a transmission, and more particularly to a linear hydraulic actuator for a transmission having a moveable sleeve and piston that move independently relative to one another in order to provide an actuator capable of obtaining three positions.

BACKGROUND

The statements in this section merely provide background information related to the present disclosure and may or may not constitute prior art.

Typical automatic and dual clutch transmissions employ a hydraulic control system operable to perform various functions within the transmission. Examples of these functions include controlling torque transmitting devices, cooling, lubrication, and the actuation of valve assemblies and components. The torque-transmitting devices may include a series of synchronizers operable to selectively connect, for example, a gear to a driveshaft. These synchronizers may be operated mechanically through a hydraulically operated piston actuator assembly.

A piston actuator assembly is controlled by pressurized hydraulic fluid to effect a position change in the mechanical device connected to the actuator. One type of piston actuator assembly found in dual clutch transmissions having synchronizer assemblies includes a piston actuator assembly operable to mechanically move a shift fork in the synchronizer assembly in order to position a synchronizer between a neutral, or unengaged position, and at least one engaged position. In the neutral position, the synchronizer is not engaged with a gear. In the first engaged position, the synchronizer is engaged with a first gear. In the second engaged position, the synchronizer is engaged with a second gear.

While these piston actuators are useful for their intended purpose, there is a constant desire to reduce the complexity of the control algorithm which returns the pistons or valves back to a neutral location and to improve the packaging efficiency of the actuator while maintaining robust and reliable operation. Accordingly, there is room in the art for an improved hydraulic piston actuator assembly having a compact package for a confined space application, improved assembly efficiency and a simpler control algorithm.

SUMMARY

A piston actuator assembly is provided including a housing, a piston, a piston liner, a seal assembly, a first hydraulic fluid chamber and a second hydraulic fluid chamber. The piston actuator assembly is capable of moving an actuator between and to three positions. A neutral position is quickly achieved by applying equal pressures on both sides of a piston of the piston actuator assembly.

In one aspect of the present invention, the housing has a bore, a first and a second apply passage and a first and a second exhaust passage. The bore has an inner surface, an open end and a closed end. The piston actuator assembly further includes a piston slidably disposed in the bore of the housing. The piston has a head portion and a connecting rod portion. The head portion has a first and a second apply surface area and the connecting rod portion extends through the open end of the bore of the housing. The piston liner is slidably disposed in the bore of the housing between the housing and the head portion of the piston. The piston liner has a bore, a first and a second end, an inner and an outer surface and a liner apply surface area. The seal assembly is disposed in the open end of the housing bore, wherein the seal assembly has a sealing surface through which the connecting rod portion of the piston is sealingly supported. The first hydraulic fluid chamber is defined by at least the inner surface of the bore of the housing and the first apply surface area of the head portion of the piston, wherein the first apply passage communicates with the first hydraulic fluid chamber. The second hydraulic fluid chamber is defined by at least the inner surface of the bore of the housing, the liner apply surface area of the piston liner, the second apply surface area of the head portion of the piston and the sealing surface of the seal assembly. The second apply passage communicates with the second hydraulic fluid chamber. The hydraulic passages are selectively pressurized to move the head of the piston into at least three positions. A first position is defined by the head of the piston adjacent the closed end of the bore of the housing. A second position is defined by the head of the piston adjacent the seal assembly. A third position is defined by the head of the piston disposed approximately midway between the closed end of the bore of the housing and the seal assembly.

In another aspect of the present invention, the seal assembly further includes a first and a second seal, wherein the first seal has an inner cavity and the second seal is disposed in the inner cavity of the first seal.

In yet another aspect of the present invention, the seal assembly further includes a center bore and an annular channel, wherein the annular channel is in communication with the center bore and the first exhaust passage of the housing.

In yet another aspect of the present invention, the piston actuator assembly further includes an annular channel defined by the inner surface of the bore of the housing and the outer surface of the piston liner, wherein the annular channel is in communication with the second exhaust passage of the housing.

In yet another aspect of the present invention, the seal assembly further includes a first and a second connecting rod seal and a bushing, wherein the first and second connecting rod seal and bushing are disposed on the inner diameter of the cylinder of the seal assembly.

In yet another aspect of the present invention, the piston further includes a center bore and a piston pin wherein the center bore of the piston has an open end at the second apply surface area of the head portion of the piston. The piston liner further includes a center guide wherein the center guide has a pair of slots and is attached to the second end of the piston liner and extends into the center bore of the head portion of the piston. The piston pin is disposed in the head portion of the piston and passes through the pair of slots of the center guide slidably securing the piston to the center guide of the piston liner.

In yet another aspect of the present invention, the bore of the housing further includes a bore liner having a first end and an outer surface. The first end of the bore liner is in contact with the seal surface of the seal assembly and the outer surface of the bore liner is in contact with the inner surface of the housing bore.

In yet another aspect of the present invention, the piston liner further includes a first and a second seal groove and a first and a second ring seal. The first seal groove is disposed in the outer surface of the piston liner proximate to the first end, the second seal groove is disposed in the outer surface of the piston liner proximate to the second end, the first ring seal is disposed in the first seal groove and the second ring seal is disposed in the second seal groove.

In yet another aspect of the present invention, the piston liner further includes a retainer groove and a ring retainer, wherein the retainer groove is disposed on the inner surface of the piston liner proximate to the first end and the ring retainer is disposed in the groove.

In yet another aspect of the present invention, the piston liner further includes an exhaust fluid passage disposed between the first and the second seal groove connecting the inner surface and the outer surface of the piston liner.

In yet another aspect of the present invention, the piston liner further includes a rim, a retainer groove and a ring retainer. The rim is disposed on the inner surface of the piston liner proximate to the first end and the retainer groove is disposed on the inner surface of the piston liner proximate to the second end and the ring retainer is disposed in the retainer groove.

In yet another aspect of the present invention, the piston liner further includes a retainer groove and a ring retainer. The retainer groove is disposed on the inner surface of the piston liner proximate to the second end and the ring retainer is disposed in the retainer groove.

In yet another aspect of the present invention, the piston head further includes an outer surface, a seal groove and a ring seal. The seal groove is disposed on the outer surface and the ring seal is disposed in the seal groove.

Further objects, aspects and advantages of the present invention will become apparent by reference to the following description and appended drawings wherein like reference numbers refer to the same component, element or feature.

DRAWINGS

The drawings described herein are for illustration purposes only and are not intended to limit the scope of the present disclosure in any way;

DETAILED DESCRIPTION

Figure 1A:
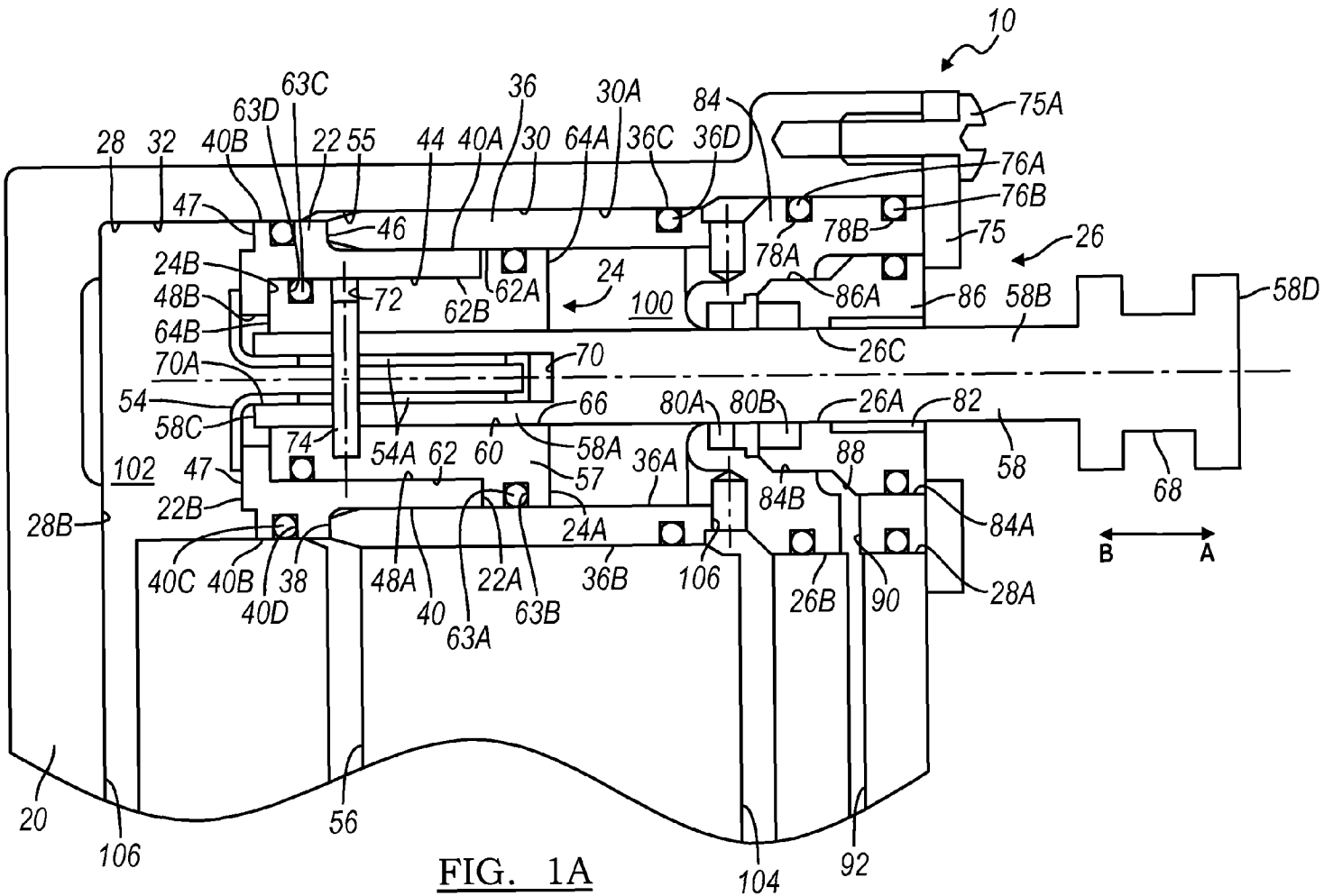
FIG. 1A is a cross-section of a piston actuator assembly in accordance with an embodiment of the present invention with the piston and piston liner in a neutral position.

The following description is merely exemplary in nature and is not intended to limit the present disclosure, application, or uses.

Referring to the drawings, wherein like reference numbers refer to like components, in FIG. 1A a cross-section of an embodiment of a piston actuator assembly 10 according to the principles of the present invention is shown and will now be described. The piston actuator assembly 10 includes a housing 20, a piston liner 22, a piston 24, and a seal assembly 26.

The housing 20 defines a bore 28 having a first portion 30 and a second portion 32. The first portion 30 is proximate an open end 28A of the bore 28 and has an inner surface 30A. A bore liner 36 is disposed in the bore 28 proximate the first portion 30. The bore liner 36 has an inner surface 36A and an outer surface 36B. The outer surface 36B is in contact with the inner surface 30A of the first portion 30 of the bore 28 and includes a seal groove 36C. A ring seal 36D is disposed in the seal groove 36C and is compressed between the bore liner 36 and the first portion 30 of the bore 28. The second portion 32 of the bore 28 is proximate a closed end 28B of the bore 28 and has an inner diameter that is larger than the inner diameter of the inner surface 36A of the bore liner 36. The difference in the diameters between the bore liner 36 and the second portion 32 of the bore 28 forms a step 38 at the interface of the bore liner 36 and the second portion 32 of the bore 28 of the housing 20.

The piston liner 22 is slidably disposed between the bore liner 36 and the piston assembly 24 and is configured to coordinate movement with the piston assembly 24, as will be described in greater detail below. The piston liner 22 is generally annular and includes an outer surface 40, an inner surface 42, a first end 22A and a second end 22B opposite the first end 22A. The outer surface 40 includes a first portion 40A and a second portion 40B. The second portion 40B has an outer diameter greater than an outer diameter of the first portion 40A. The second portion 40B is sealingly engaged with the inner surface 32 of the housing 20. In the example provided, a seal ring 40C is located within a seal groove 40D formed in the second portion 40B of the outer surface 40. However, it should be appreciated that other methods and mechanisms for sealing the piston liner 22 to the housing 20 may be employed without departing from the scope of the present invention. The outer surface 40 further includes a radially extending step portion 46 located between the first and second portions 40A, 40B. The step portion 46 acts as a stop for the piston liner 22 against the step 38 of the bore liner 28. The inner surface 42 of the piston liner 22 defines a bore 22C. The bore 22C extends through the piston liner 22 and communicates with a first opening 48A located in the first end 22A and with a second opening 48B located in the second end 22B. The outer and inner surfaces 40, 42 of the piston liner at least partially coordinate to define a liner apply surface 47. The liner apply surface 47 is a surface of the piston liner 22 proximate the second end 22B on which a pressurized hydraulic fluid acts causing the piston liner 22 to move within the bore 36 of the housing 20.

The piston liner 22 further includes a piston guide 54 fixed to the second end 22B of the piston liner 22. The piston guide 54 extends through the bore 22C of the piston liner 22 and into the opening 48A. The piston guide 54 includes a pair of slots 54A on opposite sides of the piston guide 54.

The piston liner 22 slides linearly within the bore 28 of the housing 20. The step 38 of the bore liner 36 confines the linear movement of the piston liner 22 in a first direction A and the second end 28B of the bore 28 confines the linear movement of the piston liner 22 in a second direction B.

The step 46 of the piston liner 22 coordinates with the step 38 of the bore liner 36 to from an annular channel 55 between the bore 28 of the housing 20, the bore liner 36 and the piston liner 22. Pressurized hydraulic fluid that passes by the ring seal 40C of the piston liner 22 collects in the annular channel 55. The annular channel 55 communicates with a first exhaust passage 56 of the housing 20 to prevent an accumulation of pressurized hydraulic fluid from affecting the predictive movement of the piston liner 22.

The piston 24 is slidably disposed in the bore 28 of the housing 20 and is configured to coordinate with the piston liner 22, as will be described in greater detail below. The piston 24 includes a piston head 57 secured to an elongated connecting rod 58. The piston head 57 includes an inner surface 60, an outer surface 62, a first end 24A and a second end 24B opposite the first end 24A. The outer surface 62 includes a first portion 62A proximate the first end 24A of the piston 24 and a second portion 62B proximate the second end 24B of the piston 24. The first portion 62A has an outer diameter larger than an outer diameter of the second portion 62B. The first portion 62A is sealingly engaged with the inner surface 36D of the bore liner 36 and the second portion 62B is sealingly engaged to the inner surface 42 of the piston liner 22. For example, a seal ring 63A is located within a seal groove 63B formed in the first portion 62A of the outer surface 62 and a seal ring 63C is located within a seal groove 63D formed in the second portion 62B of the outer surface 62. However, it should be appreciated that other methods and mechanisms for sealing the piston 24 to the bore liner 36 and the piston liner 22 may be employed without departing from the scope of the present invention.

The piston 24 further includes a first piston apply surface 64A and a second piston apply surface 64B. The first and second piston apply surfaces 64A, 64B are the surfaces of the piston 24 on which the hydraulic fluid acts to cause the piston 24 to move within the piston liner 22 and bore 28 of the housing 20. The first piston apply surface 64A is the exposed surface of the first end 24A of the piston head 57. The second piston apply surface 64B is the exposed surface of the second end 24B of the piston head 57.

The connecting rod 58 includes a first portion 58A and a second portion 58B. More specifically, the first portion 58A of the connecting rod 58 has an end 58C and is fixedly disposed in a center bore 66 formed by the inner surface 60 of the piston head 57. The second portion 58B of the connecting rod 58 includes an end portion 58D that extends through the first end 30 of the bore 28 of the housing 20. A groove 68 is formed in an end portion 58D of the second portion 58B to allow for connection to, for example, a shift fork (not shown) or other operable mechanism. However, it should be appreciated that other methods and mechanisms for connecting the connecting rod 58 to another operable mechanism may be employed without departing from the scope of the present invention. The connecting rod 58 further includes a center bore 70 extending from the end 58C of the first portion 58A into the connecting rod 58. The center bore 70 has an opening 70A in the end 58C through which the piston guide 54 extends. The piston 24 further includes a piston pin bore 72 disposed perpendicularly to the center bore 70 of the connecting rod 58. More specifically, the piston pin bore 72 passes through the second portion 62B of the piston head 57 and the first portion 58A of the connecting rod 58. A piston pin 74 is fixedly disposed in the pin bore 72, passing through the center bore 70 of the connecting rod 58 and the slots 54A of the piston guide 54. The piston pin 74 coordinates with the piston guide 54 and slots 54A to confine relative movement between the piston 24 and the piston liner 22 to the length of the piston guide slots 54A. However, it should be appreciated that other methods and mechanisms of confining relative movement between the piston liner 22 and the piston 24 may be employed without departing from the scope of the present invention.

The seal assembly 26 is disposed in the first end 28A of the bore 28 of the housing 20 and is retained by a seal retainer 75 fixed to the housing 20 by a fastener 75A. The seal assembly 26 has an inner surface 26A and an outer surface 26B. The inner surface 26A forms a bore 26C through which the connecting rod 58 of the piston 24 passes. The outer surface 26B is sealingly engaged with the inner surface 30A of the bore 30 of the housing 20. Also, the inner surface 26A is sealingly engaged with and provides support to the connecting rod 58. In the example provided, a first ring seal 76A and a second ring seal 76B are located, respectively, in a first seal groove 78A and a second seal groove 78B. The ring seals 76A, 76B are compressed between the outer surface 26B of the seal assembly 26 and the bore 28 of the housing 20 providing a high pressure hydraulic seal. Furthermore, a first seal 80A, a second seal 80B, and a bearing 82 are located on the inner surface 26A. The seals 80A, 80B provide a dynamic high pressure seal between the inner surface 26A of the seal assembly 26 and the connecting rod 58 while the bearing 82 provides radial support to the connecting rod 58. However, it should be appreciated that other methods and mechanisms for sealing the sealing assembly 26 to the bore 30 and supporting and sealing the connecting rod 58 may be employed without departing from the scope of the present invention.

The seal assembly 26 includes a first seal carrier 84 and a second seal carrier 86. The first seal carrier 84 has an inner surface 84A that forms an internal cavity 84B in which is disposed the second seal carrier 86. The second seal carrier 86 is sealingly engaged with the inner surface 84A of the first seal carrier 84. Furthermore, the second seal carrier 86 has an outer surface 86A that coordinates with the inner surface 84A of the first seal carrier 84 to form an annular channel 88. The annular channel 88 collects hydraulic fluid that passes by the first seal 80A. The annular channel 88 is in communication with an exhaust fluid passage 90 in the first seal carrier 84. The exhaust fluid passage 90 in the first seal carrier 84 is in communication with a second exhaust fluid passage 92 of the housing 20. The seal assembly 26 contemplated provides maximum flexibility and interchangeability, however it should be appreciated that other methods and mechanisms of sealing the bore 28 may be employed without departing from the scope of the present invention.

The piston actuator assembly 10 further includes a first hydraulic pressure chamber 100 and a second hydraulic pressure chamber 102. The hydraulic pressure chambers 100, 102 are generally formed by the coordination of the surfaces of the bore 28 of the housing 20, bore liner 36, piston liner 22, piston 24 and seal assembly 26. For example, the first hydraulic pressure chamber 100 is defined by a surface 26D of the seal assembly 26, the inner surface 36A of the bore liner 36 and the first piston apply surface 64A. The first hydraulic pressure chamber 100 communicates with a first hydraulic apply passage 104 of the housing 20 through a fluid passage 106 of the bore liner 36. Selectively pressurized fluid is introduced to the first hydraulic apply passage 104 and therefore into the first hydraulic pressure chamber 100.

The second hydraulic pressure chamber 102 is defined by at least the inner surface 30A of the bore 28 of the housing 20, the liner apply surface 44 and the second piston apply surface 64B. The second hydraulic pressure chamber 102 communicates with the second hydraulic fluid passage 106 of the housing 20. Selectively pressurized fluid is introduced to the second hydraulic fluid passage 106 and therefore into the second hydraulic pressure chamber 102.

Figure 1B:
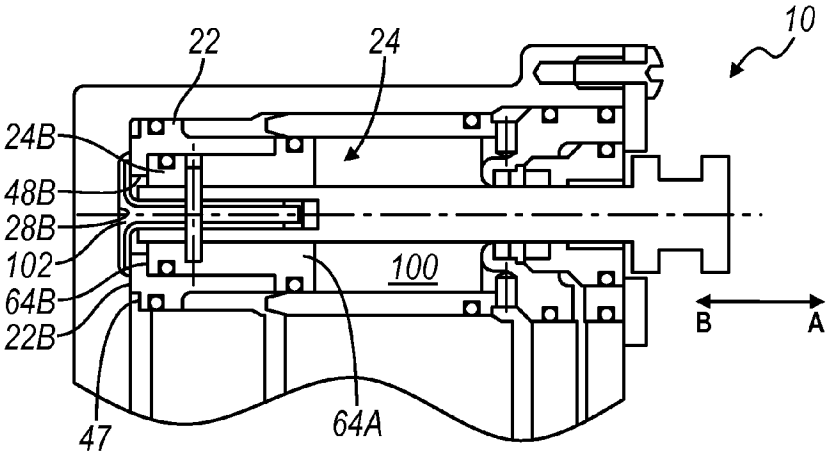
FIG. 1B is a cross-section of the piston actuator assembly with the piston and piston liner in a first position.
Figure 1C:
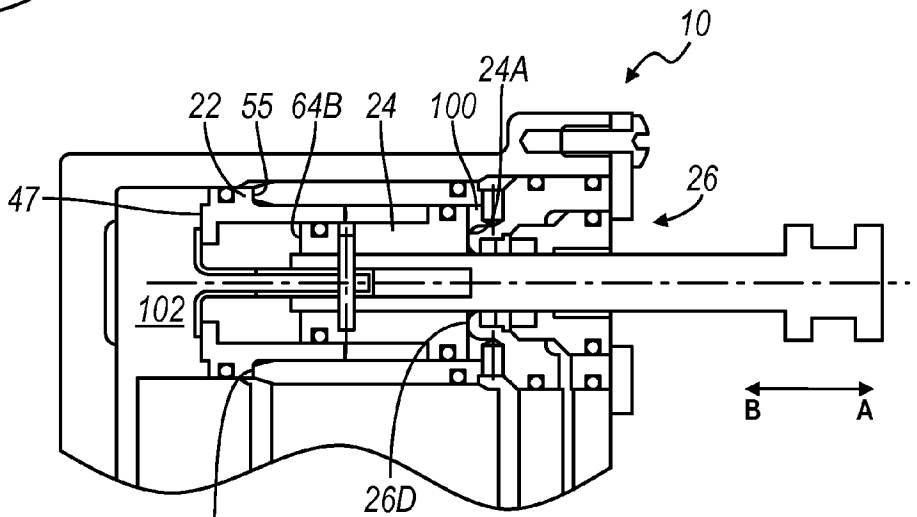
FIG. 1C is a cross-section of the piston actuator assembly with the piston and piston liner in a second position.

Referring to FIGS. 1A, 1B and 1C, the operation of the piston actuator assembly 10 will now be described. FIG. 1A illustrates a cross-section of the piston actuator assembly 10 in a neutral position. The neutral position corresponds to the operation of disengaging a gear from the synchronizer or a drive shaft. The neutral position is typically achieved by partially pressurizing the first pressure cavity 100 and the second pressure cavity 102 to approximately equal pressures. The hydraulic fluid contacts the surfaces of the first pressure cavity 100 thus implementing a resulting pressure on the first piston apply surface 64A of the first pressure cavity 100. Furthermore, the hydraulic fluid contacts the surfaces of the second pressure cavity 102 thus implementing a resulting pressure on the second piston apply surface 64B and the liner apply surface 47 of the second pressure cavity 100. The resultant force on the second piston and liner apply surfaces 47, 64B overcome the resultant force on the first piston apply surface 64A and the hydraulic fluid moves the piston 24 and piston liner 22 until the step 46 of the piston liner 22 contact the step 38 of the bore liner 36. At this point the resultant force generated by the hydraulic fluid acting on the second piston apply surface 64B alone is not enough to overcome the apply force acting on the first piston apply surface 64A so the piston 24 and piston liner stops moving in the defined neutral position. Accordingly, in the neutral position, the piston 24 is positioned such that the second end 24B of the piston contacts the piston liner 22 proximate the second end 22B and the radial step 55 of the piston liner 22 contacts the radial step 28 of the bore liner 36.

FIG. 1B illustrates a cross-section of the piston actuator assembly 10 placed in a first position. The first position corresponds to the operation of engaging a first gear to the synchronizer or a drive shaft. The first position is achieved by pressurizing the first pressure cavity 100 and depressurizing the second pressure cavity 102. The hydraulic fluid contacts the surfaces of the first pressure cavity 100 thus implementing a resulting pressure on the first piston apply surface 64A of the first pressure cavity 100. Furthermore, the hydraulic fluid is allowed to drain with or without pressure assistance from the second pressure cavity 102. The resultant force on the first apply surface 64A due to the hydraulic fluid moves the piston 24 in the B direction. Accordingly, in the first position, the piston 24 is positioned such that the second end 24B of the piston contacts the piston liner 22 proximate the second end 22B and the second end 22B of the piston liner 22 is positioned proximate the closed end 28B of the bore 28.

FIG. 1C illustrates a cross-section of an embodiment of the piston actuator assembly 10 placed in a second position. The second position corresponds to the operation of engaging a second gear to a synchronizer or a drive shaft. If the piston actuator assembly 10 is moving from the first position, the first gear is disengaged and the second gear is engaged after the piston 24 passes through the neutral position. The second position is achieved by depressurizing the first pressure cavity 100 and pressurizing the second pressure cavity 102. The hydraulic fluid contacts the surfaces of the second pressure cavity 102 thus implementing a resulting pressure on the second piston apply surface 64B and the liner apply surface 47 of the second pressure cavity 102. Furthermore, the hydraulic fluid is allowed to drain with or without pressure assistance from the first pressure cavity 100. The resultant force on the apply surfaces 47, 64B due to the hydraulic fluid moves the piston 24 and piston liner 22 in the A direction. Accordingly, in the second position, the piston 24 and the piston liner 22 are positioned such that the first end 24A of the piston is positioned proximate a surface 26D of the seal assembly 26 and the radial step 55 of the piston liner 22 contacts the radial step 38 of the bore liner 36 and maintains position of the piston liner 22.

Figure 2A:
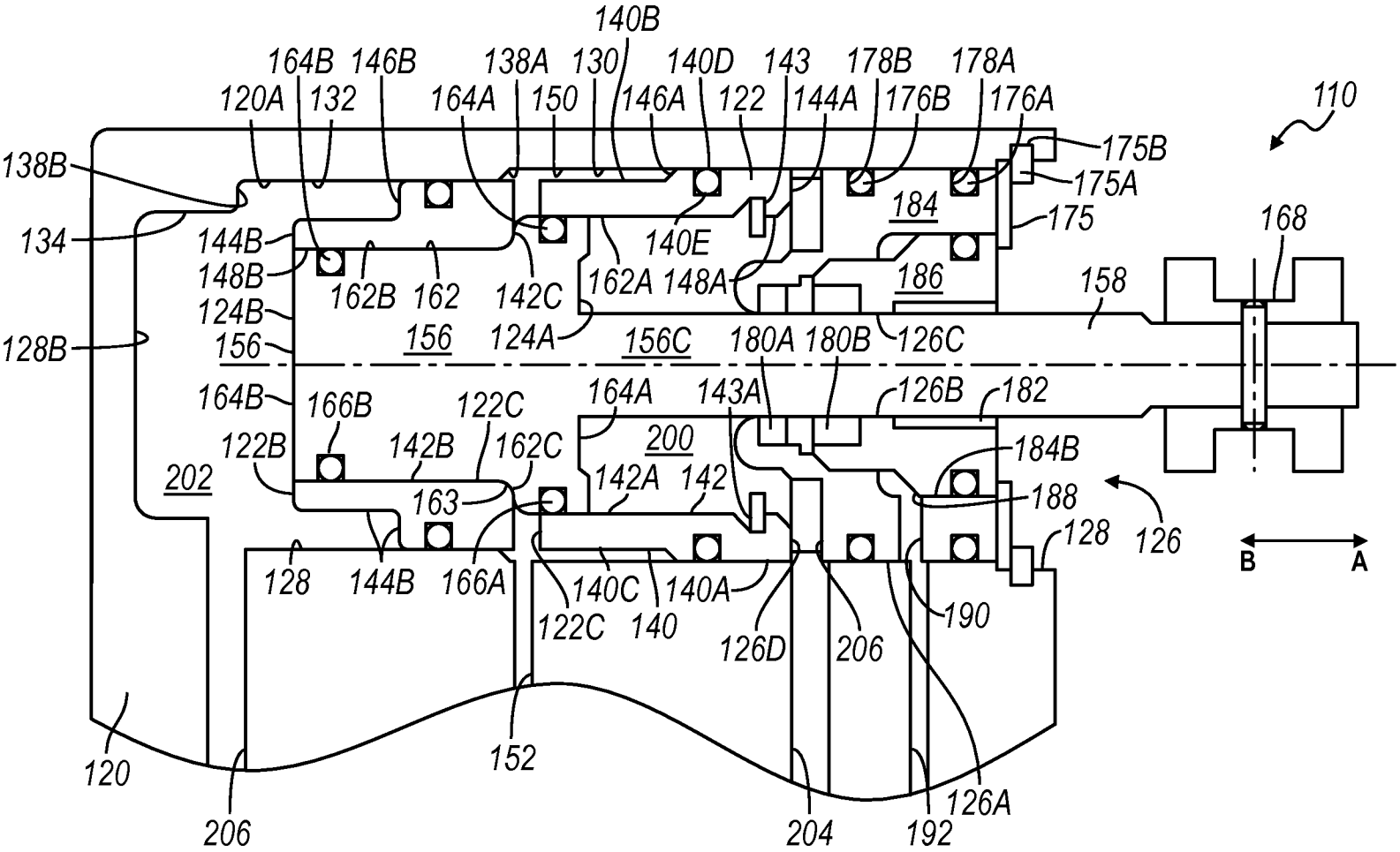
FIG. 2A is a cross-section of a piston actuator assembly in accordance with an embodiment of the present invention with the piston and piston liner in a neutral position.

Referring now to FIG. 2A a cross-section of a second embodiment of a piston actuator assembly 110 is shown and will now be described. The piston actuator assembly 110 includes a housing 120, a piston liner 122, a piston 124, and a seal assembly 126. The housing 120 includes an inner surface 120A that defines a bore 128. The inner surface 120A has a first portion 130, a second portion 132, and a third portion 134. The first portion 130 is proximate an open end 128A of the bore 128 and has an inner surface 130A. The second portion 132 is proximate a closed end 128B of the bore 128. The third portion 134 is disposed between the first and second portions 130, 132 and has an inner diameter that is smaller than the inner diameter of the first portion 130 and larger than the inner diameter of the second portion 132. The inner surface 120A of the housing 120 further includes a first radially extending step portion 138A and a second radially extending step portion 138B. The first step portion 138A is formed at the interface of the first portion 130 and the third portion 134. The second step portion 138B is formed at the interface of the second portion 132 and the third portion 134.

The piston liner 122 is slidably disposed between the inner surface 120A of the housing 120 and the piston assembly 124 and is configured to coordinate movement with the piston assembly 124, as will be described in greater detail below. The piston liner 122 is generally annular and includes an outer surface 140, an inner surface 142, a first end 122A and a second end 122B opposite the first end 122A. The outer surface 140 includes a first portion 140A, a second portion 140B and a third portion 140C. The first portion 140A is disposed proximate to the first end 122A of the piston liner 122 and has an outer diameter larger than the second portion 140B. The second portion 140B is disposed proximate the second end 122B of the piston liner 122. The third portion 140C is disposed between the first portion 140A and the second portion 140B and has an outer diameter smaller than the outer diameter of the first portion 140A and larger than the outer diameter of the second portion 140B. The first portion 140A and third portion 140C are sealingly engaged with the first portion 130 and the third portion 134, respectively, of the inner surface 132 of the housing 120. In the example provided, a first seal ring 141A is located in a first seal groove 141B formed in the first portion 140A of the outer surface 140. Also, a second seal ring 141C is located in a second seal groove 141D formed in the third portion 140C of the outer surface 140. However, it should be appreciated that other methods and mechanisms for sealing the piston liner 122 to the housing 120 may be employed without departing from the scope of the present invention.

The outer surface 140 further includes a first radially extending step portion 146A and a second radially extending step portion 146B. The first step portion 146A is located between the first portion 140A and the third portion 140C. The second step portion 146B is located between the second portion 140B and the third portion 140C. The first step portion 146A coordinates with the first step portion 138A of the inner surface 120A of the housing 120 to form a first annular channel 150 between the bore 128 and the piston liner 122. Pressurized hydraulic fluid that passes by the ring seal 140D of the piston liner 122 collects in the first annular channel 150. The first annular channel 150 communicates with a first exhaust passage 152 of the housing 120 to prevent an accumulation of pressurized hydraulic fluid from affecting the predictive movement of the piston liner 122. The second step portion 146B acts as a stop for the piston liner 122 against the second step portion 138B of the inner surface 120A of the housing 120.

The inner surface 142 of the piston liner 122 defines a bore 122C. The bore 122C extends through the piston liner 122 and communicates with a first opening 148A located in the first end 122A and with a second opening 148B located in the second end 122B. The inner surface 142 has a first portion 142A located proximate the first end 122A of the piston liner 122 and a second portion 142B located proximate the second end 122B. The first portion 142A of the inner surface 142 of the piston liner 122 has a larger inner diameter than the second portion 142B. The inner surface 142 of the piston liner 122 further includes a radially extending step portion 142C that is formed at the interface of the first portion 142A and the second portion 142B of the inner surface 142 of the piston liner 122. The first portion 142A of the inner surface further includes a retainer ring 143 disposed in a groove 143A which limits travel of the piston 124 relative to the piston liner 122. However, it should be appreciated that other methods and mechanisms of limiting relative movement of the piston 124 within the piston liner 122 may be employed without departing from the scope of the present invention.

The piston liner 122 further includes a first liner apply surface 144A and a second liner apply surface 144B. The first liner apply surface 144A is a surface of the piston liner 122 proximate the first end 122A on which a pressurized hydraulic fluid acts causing the piston liner 122 to move within the bore 128 of the housing. The second liner apply surface 144B is a surface of the piston liner 122 proximate the second end 122B on which a pressurized hydraulic fluid acts causing the piston liner 122 to move within the bore 128 of the housing.

The piston 124 is slidably disposed in the bore 128 of the housing 120 and is configured to coordinate with the piston liner 122, as will be described in greater detail below. The piston 124 includes a head portion 156 and an elongated connecting rod portion 158. The head portion 156 includes an outer surface 162, a first end 124A and a second end 124B opposite the first end 124A. The outer surface 162 includes a first portion 162A proximate the first end 124A and a second portion 162B proximate the second end 124B. The first portion 162A has an outer diameter larger than an outer diameter of the second portion 162B. The first portion 162A and the second portion 162B are sealingly engaged with the first portion 142A and the second portion 142B, respectively, of the inner surface 142 of the piston liner 122. In the example provided, a seal ring 164A is located within a seal groove 166A formed in the first portion 162A of the outer surface 162 of the head portion 156. Also, a seal ring 164B is located within a seal groove 166B formed in the second portion 162B of the outer surface 162 of the head portion 156.

The outer surface 162 of the head portion 156 further includes a radially extending step portion 162C formed at the interface of the first portion 162A and the second portion 162B of the outer surface. The step portion 162C of the head portion 154 of the piston 124 coordinates with the step portion 142C of the inner surface 142 of the piston liner 122 to act as a stop preventing further movement of the piston 124 in the B direction relative to the piston liner 122. Also, the step portion 162C of the outer surface 162 of the head portion 154 coordinates with the step portion 142C of the inner surface 142 of the piston liner 122 to form a second annular channel 163 between the piston 124 and the piston loner 122. Pressurized hydraulic fluid that passes by the ring seals 164A, 164B of the head portion 154 of the piston 124 collects in the second annular channel 163. The second annular channel 163 communicates with an exhaust passage 122C of the piston liner 122, the first annular channel 150 and the first exhaust passage 152 of the housing 120 to prevent an accumulation of pressurized hydraulic fluid from affecting the predictive movement of the piston 124. Furthermore, the first end 124A of the head portion 154 of the piston 124 coordinates with the retainer ring 143 of the piston liner 122 to act as a stop preventing further movement of the piston 124 in the A direction relative to the piston liner 122.

The piston 124 further includes a first piston apply surface 164A and a second piston apply surface 164B. The first and second piston apply surfaces 164A, 164B are the surfaces of the piston 124 on which the hydraulic fluid acts to cause the piston 124 to move within the piston liner 122 and bore 128 of the housing 120. The first piston apply surface 164A is the exposed surface of the first end 124A of the head portion 156. The second piston apply surface 164B is the exposed surface of the second end 124B of the head portion 156.

The connecting rod portion 158 includes a first portion 158A and a second portion 158B. More specifically, the first portion 158A of the connecting rod portion 158 has an end 158C fixedly attached to the first end 124A of the head portion 156. The second portion 158B extends through the open end 130 of the bore 128 of the housing 20. A groove 168 is formed in the second portion 158B to allow for connection to, for example, a shift fork (not shown) or other operable mechanism. However, it should be appreciated that other methods and mechanisms of connection may be employed without departing from the scope of the present invention.

The seal assembly 126 is disposed in the first end 128A of the bore 128 of the housing 120 and is retained by a plate 175 held in place by a ring retainer 175A disposed in a groove 175B formed in the housing 120 proximate the open end 128A. The seal assembly 126 has an inner surface 126A and an outer surface 126B. The inner surface 126A forms a bore 126C through which the connecting rod 158 of the piston 124 passes. The outer surface 126B is sealingly engaged with the inner surface 130A of the bore 130 of the housing 120. Also, the inner surface 126A is sealingly engaged to the connecting rod portion 158. In the example provided, a first ring seal 176A and a second ring seal 176B are located, respectively, in a first seal groove 178A and a second seal groove 178B. The ring seals 176A, 176B are compressed between the outer surface 126B of the seal assembly 126 and the bore 128 of the housing 120 providing a high pressure hydraulic seal. Furthermore, a first seal 180A, a second seal 180B, and a bearing 182 are located on the inner surface 126A. The seals 180A, 180B provide a dynamic high pressure seal between the inner surface 126A of the seal assembly 126 and the connecting rod portion 158 while the bearing 182 provides radial support to the connecting rod portion 158. However, it should be appreciated that other methods and mechanisms for sealing the sealing assembly 126 to the bore 130 and the connecting rod portion 158 may be employed without departing from the scope of the present invention.

The seal assembly 126 includes a first seal carrier 184 and a second seal carrier 186. The first seal carrier 184 has an inner surface 184A that forms an internal cavity 184B in which is disposed the second seal carrier 186. The second seal carrier 186 is sealingly engaged with the inner surface 184A of the first seal carrier 184. Furthermore, the second seal carrier 186 has an outer surface 186A that coordinates with the inner surface 184A of the first seal carrier 184 to form an annular channel 188. The annular channel 188 collects hydraulic fluid that passes by the first seal 180A. The annular channel 188 is in communication with an exhaust fluid passage 190 in the first seal carrier 184. The exhaust fluid passage 190 in the first seal carrier is in communication with a second exhaust fluid passage 192 of the housing 120.

The piston actuator assembly further includes a first hydraulic pressure chamber 200 and a second hydraulic pressure chamber 202. The hydraulic pressure chambers 200, 202 are formed by the coordination of the surfaces of the bore 128 of the housing 20, piston liner 122, piston 124 and seal assembly 126. For example, the first hydraulic pressure chamber 200 is defined by at least the inner surface 120A of the bore 128, a surface 126D of the seal assembly 126, the first liner apply surface 144A and the first piston apply surface 164A. The first hydraulic pressure chamber 200 communicates with a first hydraulic apply passage 204 of the housing 120. Selectively pressurized fluid is introduced to the first hydraulic apply passage 204 and therefore into the first hydraulic pressure chamber 200.

The second hydraulic pressure chamber 202 is defined by at least the inner surface 120A of the bore 128, the second liner apply surface 144B and the second piston apply surface 164B. The second hydraulic pressure chamber 202 communicates with the second hydraulic fluid passage 206 of the housing 120. Selectively pressurized fluid is introduced to the second hydraulic fluid passage 206 and therefore into the second hydraulic pressure chamber 202.

Figure 2B:
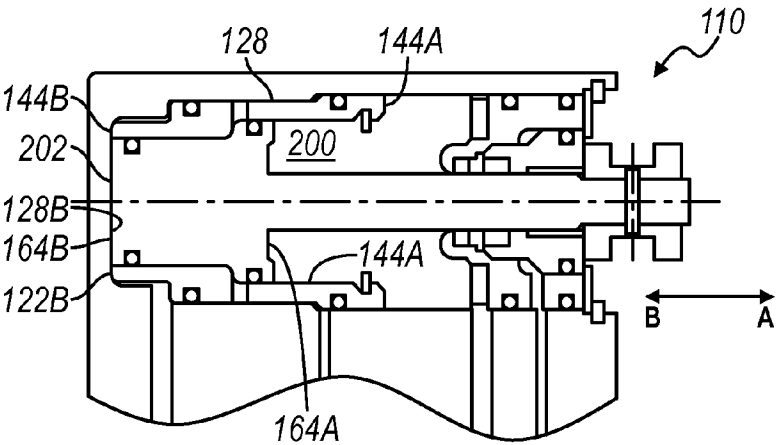
FIG. 2B is a cross-section of the piston actuator assembly with the piston and piston liner in a first position.
Figure 2C:
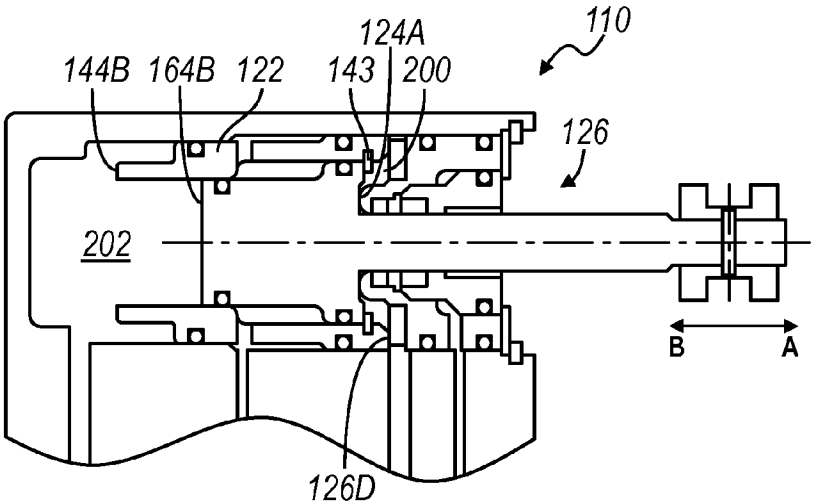
FIG. 2C is a cross-section of the piston actuator assembly with the piston and piston liner in a second position.

Referring to FIGS. 2A, 2B and 2C, the operation of the piston actuator assembly 110 will now be described. FIG. 2A illustrates a cross-section of the piston actuator assembly 110 in a neutral position. The neutral position corresponds to the operation of disengaging a gear from the synchronizer or a drive shaft. The neutral position is achieved by partially pressurizing the first pressure cavity 200 and the second pressure cavity 202. The hydraulic fluid contacts the surfaces of the first pressure cavity 200 thus implementing a resulting pressure on the first piston apply surface 164A and the first liner apply surface 144A of the first pressure cavity 200. Furthermore, the hydraulic fluid contacts the surfaces of the second pressure cavity 202 thus implementing a resulting pressure on the second piston apply surface 164B and the second liner apply surface 144B of the second pressure cavity 200. The resultant force on the second piston and second liner apply surfaces 144B 164B overcome the resultant forces on the first piston and second liner apply surfaces 144A, 164A and the hydraulic fluid moves the piston 124 and piston liner 122 until the first end 122A of the piston liner 122 contacts a surface 126D of the seal assembly. The resultant force generated by the hydraulic fluid acting on the second apply surface 164B is not enough to overcome the force acting on the first apply liner apply surface 164A. The piston liner 122 stops moving in the defined neutral position. Accordingly, in the neutral position, the piston 124 is positioned such that the radial step 162A of the piston 124 contacts the radial step 142C of the inner surface 142 of the piston liner 122 and the first end 122A of the piston liner 122 contacts a surface 126D of the seal assembly.

FIG. 2B illustrates a cross-section of the piston actuator assembly 110 placed in a first position. The first position corresponds to the operation of engaging a first gear to the synchronizer or a drive shaft. The first position is achieved by pressurizing the first pressure cavity 200 and depressurizing the second pressure cavity 202. The hydraulic fluid contacts the surfaces of the first pressure cavity 200 thus implementing a resulting pressure on the first piston apply surface 164A and the first liner apply surface 144A of the first pressure cavity 200. Furthermore, the hydraulic fluid is allowed to drain from the second pressure cavity 202. The resultant force on the first apply surfaces 144A, 164A due to the hydraulic fluid moves the piston 124 in the B direction. Accordingly, in the first position, the piston 124 is positioned such that the radial step 162A of the piston contacts the radial step 142C of the inner surface 142 of the piston liner 122 and the second end 122B of the piston liner 122 is proximate the closed end 128B of the bore 128.

FIG. 2C illustrates a cross-section of an embodiment of the piston actuator assembly 110 placed in a second position. The second position corresponds to the operation of disengaging a gear from the synchronizer or a drive shaft. If actuated from the first position, the first gear is disengaged and then the second gear is engaged after passing through the neutral position. The second position is achieved by depressurizing the first pressure cavity 200 and pressurizing the second pressure cavity 202. The hydraulic fluid contacts the surfaces of the second pressure cavity 202 thus implementing a resulting pressure on the second piston apply surface 164B and the second liner apply surface 144B of the second pressure cavity 202. Furthermore, the hydraulic fluid is allowed to drain from the first pressure cavity 200. The resultant force on the second apply surfaces 144B, 164B due to the hydraulic fluid moves the piston 124 and piston liner 122 in the A direction. Accordingly, in the second position, the piston 124 and the piston liner 122 are positioned such that the first end 124A of the piston is proximate the retainer ring 143 of the inner surface 142 of the piston liner 122 and the first end 122A of the piston liner 122 contacts the surface 126D of the seal assembly 126.

Figure 3A:
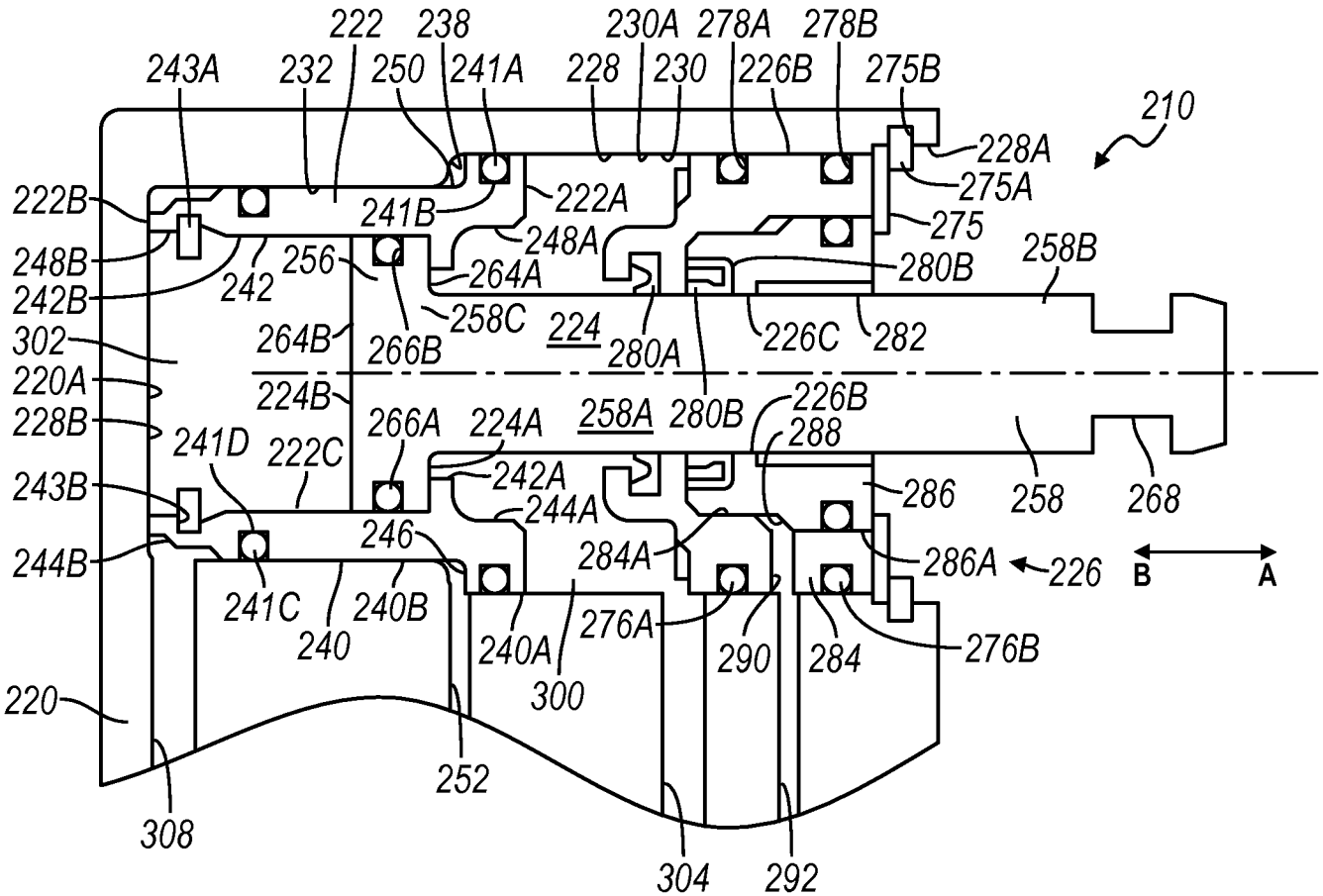
FIG. 3A is a cross-section of a piston actuator assembly in accordance with an embodiment of the present invention with the piston and piston liner in a neutral position.

Referring now to FIG. 3A a cross-section of another embodiment of a piston actuator assembly 210 is shown and will now be described. The piston actuator assembly 210 includes a housing 220, a piston liner 222, a piston 224, and a seal assembly 226. The housing 220 includes an inner surface 220A that defines a bore 228. The inner surface 220A has a first portion 230 and a second portion 232. The first portion 230 is proximate an open end 228A of the bore 228 and has an inner surface 230A. The second portion 232 is proximate a closed end 228B of the bore 228. The first portion 230 has an inner diameter that is larger than the inner diameter of the second portion 232. The inner surface 220A of the housing 220 further includes a radially extending step portion 238. The step portion 238 is formed at the interface of the first portion 230 and the third portion 234.

The piston liner 222 is slidably disposed between the inner surface 220A of the housing 220 and the piston assembly 224 and is configured to coordinate movement with the piston assembly 224, as will be described in greater detail below. The piston liner 222 is generally annular and includes an outer surface 240, an inner surface 242, a first end 222A and a second end 222B opposite the first end 222A. The outer surface 240 includes a first portion 240A and a second portion 240B. The first portion 240A is disposed proximate to the first end 222A of the piston liner 222 and has an outer diameter larger than the second portion 240B. The second portion 240B is disposed proximate the second end 222B of the piston liner 222. The first portion 240A has an outer diameter larger than the outer diameter of the second portion 240B. The first portion 240A is sealingly engaged with the first portion 230 of the inner surface 232 of the housing 220. The second portion 240B is sealingly engaged with the second portion 232 of the inner surface of the housing 220. In the example provided, a first seal ring 241A is located in a first seal groove 241B formed in the first portion 240A of the outer surface 240. Also, a second seal ring 241C is located in a second seal groove 241D formed in the third portion 240C of the outer surface 240. However, it should be appreciated that other methods and mechanisms for sealing the piston liner 222 to the housing 220 may be employed without departing from the scope of the present invention.

The outer surface 240 further includes a radially extending step portion 246 located at the interface of the first portion 240A and the third portion 240C. The step portion 246 coordinates with the step portion 238 of the inner surface 220A of the housing 220 to form an annular channel 250 between the bore 228 and the piston liner 222. Pressurized hydraulic fluid that passes by the ring seals 241A, 241C of the piston liner 222 collects in the annular channel 250. The annular channel 250 communicates with a first exhaust passage 252 of the housing 220 to prevent an accumulation of pressurized hydraulic fluid from affecting the predictive movement of the piston liner 222.

The inner surface 242 of the piston liner 222 defines a bore 222C. The bore 222C extends through the piston liner 222 and communicates with a first opening 248A located in the first end 222A and with a second opening 248B located in the second end 222B. The inner surface 242 has a first portion 242A located proximate the first end 222A of the piston liner 222 and a second portion 242B located proximate the second end 222B. The first portion 242A of the inner surface 242 of the piston liner 222 has a smaller inner diameter than the second portion 242B. The second portion 242B of the inner surface 242 further includes a retainer ring 243A disposed in a groove 243B.

The piston liner 222 further includes a first liner apply surface 244A and a second liner apply surface 244B. The first liner apply surface 244A is a surface of the piston liner 222 proximate the first end 222A on which a pressurized hydraulic fluid acts thereby causing the piston liner 222 to move within the bore 228 of the housing 220. The second liner apply surface 244B is a surface of the piston liner 222 proximate the second end 222B on which a pressurized hydraulic fluid acts thereby causing the piston liner 222 to move within the bore 228 of the housing 220.

The piston 224 is slidably disposed in the bore 228 of the housing 220 and is configured to coordinate with the piston liner 222, as will be described in greater detail below. The piston 224 includes a head portion 256 and an elongated connecting rod portion 258. The head portion 256 includes an outer surface 262, a first end 224A and a second end 224B opposite the first end 224A. The outer surface 262 is sealingly engaged with the second portion 242B of the inner surface 242 of the piston liner 222. In the example provided, a seal ring 264A is located within a seal groove 266A formed in the outer surface 262 of the head portion 256. However, it should be appreciated that other methods and mechanisms for sealing the piston 224 to the piston liner 222 may be employed without departing from the scope of the present invention.

The head portion 254 of the piston 224 coordinates with the first portion 242A of the inner surface 242 of the piston liner 222 to act as a stop preventing further movement of the piston 224 in the A direction relative to the piston liner 222. Also, the head portion 254 coordinates with the retainer ring 243A of the piston liner 222 to act as a stop preventing further movement of the piston 224 in the B direction relative to the piston liner 222.

The piston further includes a first piston apply surface 264A and a second piston apply surface 264B. The first and second piston apply surfaces 264A, 264B are the surfaces of the piston 224 on which the hydraulic fluid acts to cause the piston 224 to move within the piston liner 222 and bore 228 of the housing 220. The first piston apply surface 264A is the exposed surface of the first end 224A of the head portion 256. The second piston apply surface 264B is the exposed surface of the second end 224B of the head portion 256.

The connecting rod portion 258 includes a first portion 258A and a second portion 258B. More specifically, the first portion 258A of the connecting rod portion 258 has an end 258C fixedly attached to the first end 224A of the head portion 256. The second portion 258B extends through the open end 230 of the bore 228 of the housing 20. A groove 268 is formed in the second portion 258B to allow for connection to, for example, a shift fork (not shown) or other operable mechanism.

The seal assembly 226 is disposed in the first end 228A of the bore 228 of the housing 220 and is retained by a plate 275 held in place by a ring retainer 275A disposed in a groove 275B formed in the housing 220 proximate the open end 220A. The seal assembly 226 has an inner surface 226A and an outer surface 226B. The inner surface 226A forms a bore 226C through which the connecting rod 258 of the piston 224 passes. The outer surface 226B is sealingly engaged with the inner surface 230A of the bore 230 of the housing 220. Also, the inner surface 226A is sealingly engaged with the connecting rod portion 258. In the example provided, a first ring seal 276A and a second ring seal 276B are located, respectively, in a first seal groove 278A and a second seal groove 278B. The ring seals 276A, 276B are compressed between the outer surface 226B of the seal assembly 226 and the bore 228 of the housing 220 providing a high pressure hydraulic seal. Furthermore, a first seal 280A, a second seal 280B, and a bearing 282 are located on the inner surface 226A. The seals 280A, 280B provide a dynamic high pressure seal between the inner surface 226A of the seal assembly 226 and the connecting rod portion 258 while the bearing 282 provides radial support to the connecting rod portion 258. However, it should be appreciated that other methods and mechanisms for sealing the sealing assembly 226 to the bore 230 and sealing and supporting the connecting rod portion 258 may be employed without departing from the scope of the present invention.

The seal assembly 226 includes a first seal carrier 284 and a second seal carrier 286. The first seal carrier 284 has an inner surface 284A that forms an internal cavity 284B in which is disposed the second seal carrier 286. The second seal carrier 286 is sealingly engaged with the inner surface 284A of the first seal carrier 284. Furthermore, the second seal carrier 286 has an outer surface 286A that coordinates with the inner surface 284A of the first seal carrier 284 to form an annular channel 288. The annular channel 288 collects hydraulic fluid that passes by the first seal 280A. The annular channel 288 is in communication with an exhaust fluid passage 290 in the first seal carrier 284. The exhaust fluid passage 290 in the first seal carrier is in communication with a second exhaust fluid passage 292 of the housing 220.

The piston actuator assembly 210 further includes a first hydraulic pressure chamber 300 and a second hydraulic pressure chamber 302. The hydraulic pressure chambers 300, 302 are formed generally by the coordination of the surfaces of the bore 228 of the housing 220, piston liner 222, piston 224 and seal assembly 226. For example, the first hydraulic pressure chamber 300 is defined by at least the inner surface 220A of the bore 228, a surface 226D of the seal assembly 226, the first liner apply surface 244A and the first piston apply surface 264A. The first hydraulic pressure chamber 300 communicates with a first hydraulic apply passage 304 of the housing 220. Selectively pressurized fluid is introduced to the first hydraulic apply passage 304 and therefore into the first hydraulic pressure chamber 300.

The second hydraulic pressure chamber 302 is defined by at least the inner surface 220A of the bore 228, the second liner apply surface 244B and the second piston apply surface 264B. The second hydraulic pressure chamber 302 communicates with the second hydraulic fluid passage 308 of the housing 220. Selectively pressurized fluid is introduced to the second hydraulic fluid passage 308 and therefore into the second hydraulic pressure chamber 302.

Figure 3C:
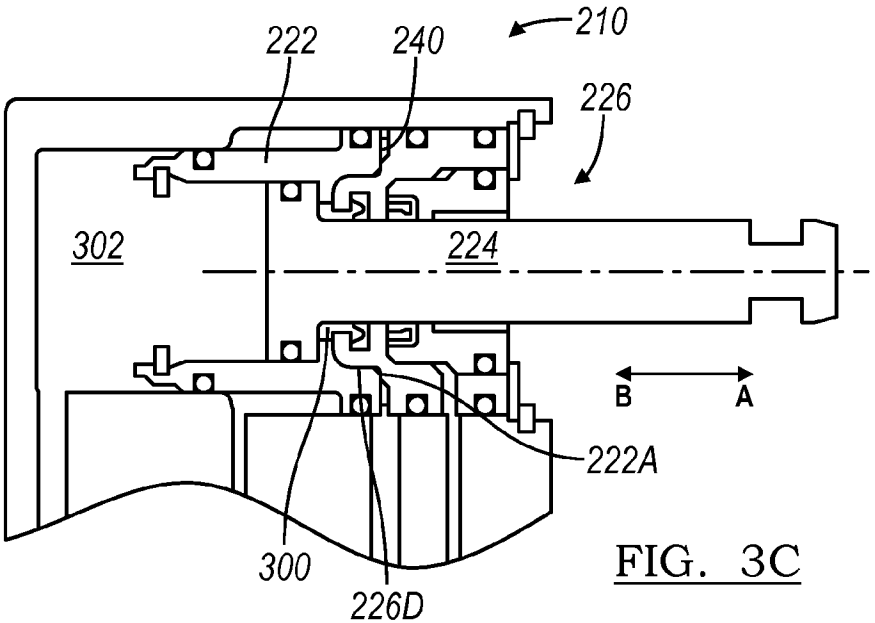
FIG. 3C is a cross-section of the piston actuator assembly with the piston and piston liner in a second position.
Figure 3B:
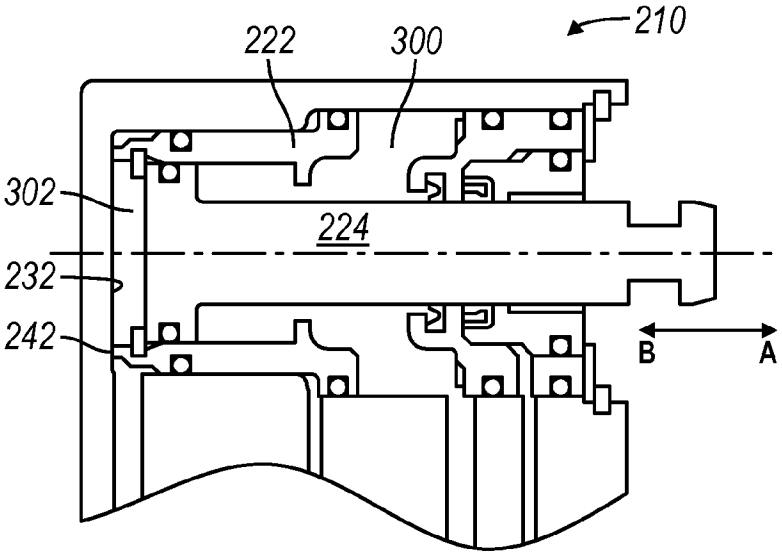
FIG. 3B is a cross-section of the piston actuator assembly with the piston and piston liner in a first position.

Referring to FIGS. 3A, 3B and 3C, the operation of the piston actuator assembly 210 will now be described. FIG. 3A illustrates the piston actuator assembly 210 in a neutral position. The neutral position corresponds to the operation of disengaging a gear from the synchronizer or a drive shaft. The neutral position is achieved by partially pressurizing the first pressure cavity 300 and the second pressure cavity 302 to approximately equal pressures. The hydraulic fluid contacts the surfaces of the first pressure cavity 300 thus implementing a resulting pressure on the first piston apply surface 264A and the first liner apply surface 244A of the first pressure cavity 300. Furthermore, the hydraulic fluid contacts the surfaces of the second pressure cavity 302 thus implementing a resulting pressure on the second piston apply surface 264B and the second liner apply surface 244B of the second pressure cavity 300. The resultant force on the first piston and first liner apply surfaces 244A, 264A overcome the resultant force acting on the second piston and second liner apply surfaces 244B, 264B. The hydraulic fluid moves the piston 224 and piston liner 222 until the first end 224A of the piston contacts the first portion 242A of the inner surface 242 of the piston liner 222 and the second end 222B of the piston liner 222 contacts the closed end 228B of the bore 228. At this point the resultant force generated by the hydraulic fluid acting on the first piston apply surface 264A is less than the force acting on the second piston apply surface 264B. The piston 224 and piston liner 222 stops moving in the defined neutral position. Accordingly, in the neutral position, the piston 224 is positioned such that the first end 224A of the piston contacts the first portion 242A of the inner surface 242 of the piston liner 222 and the second end 222B of the piston liner 222 contacts the closed end 228B of the bore 228.

FIG. 3B illustrates a cross-section of the piston actuator assembly 210 placed in a first position. The first position corresponds to the operation of engaging a first gear to the synchronizer or a drive shaft. The first position is achieved by pressurizing the first pressure cavity 300 and depressurizing the second pressure cavity 302. The hydraulic fluid contacts the surfaces of the first pressure cavity 300 thus implementing a resulting pressure on the first piston apply surface 264A and the first liner apply surface 244A of the first pressure cavity 300. Furthermore, the hydraulic fluid is allowed to drain from the second pressure cavity 302. The resultant force on the first apply surfaces 264A, 244A due to the hydraulic fluid moves the piston 224 in the B direction. Accordingly, in the first position, for example, the piston 224 is positioned such that the second end 224B of the head portion 256 of the piston 224 contacts the ring retainer 243A of the inner surface 242 of the piston liner 222 and the second end 222B of the piston liner 222 is proximate the closed end 228B of the bore 228. However, it should be appreciated that the piston 224 may not contact the ring retainer 243A in the first position without departing from the scope of the present invention.

FIG. 3C illustrates a cross-section of an embodiment of the piston actuator assembly 210 placed in a second position. The second position corresponds to the operation of engaging a second gear from the synchronizer or a drive shaft. If actuated from the first position, the first gear will be disengaged and then the second gear will be engaged after passing through neutral. The second position is achieved by depressurizing the first pressure cavity 300 and pressurizing the second pressure cavity 302. The hydraulic fluid contacts the surfaces of the second pressure cavity 302 thus implementing a resulting pressure on the second piston apply surface 264B and the second liner apply surface 244B of the second pressure cavity 302. Furthermore, the hydraulic fluid is allowed to drain from the first pressure cavity 300. The resultant force on the second apply surfaces 264B, 244B due to the hydraulic fluid moves the piston 224 and piston liner 222 in the A direction. Accordingly, in the second position, for example, the piston 224 and the piston liner 222 are positioned such that the first end 224A of the piston contacts the first portion 242A of the inner surface 242 of the piston liner 222 and the first end 222A of the piston liner 222 is proximate a surface 226D of the seal assembly 226. However, it should be appreciated that the first end 224A of the piston may not contact the first portion 242A of the inner surface 242 of the piston liner 222 without departing from the scope of the present invention.

The description of the invention is merely exemplary in nature and variations that do not depart from the gist of the invention are intended to be within the scope of the invention. Such variations are not to be regarded as a departure from the spirit and scope of the invention.

What is claimed is:

1. A piston actuator assembly comprising:

a housing having a bore, a first and a second apply passage and a first and a second exhaust passage, wherein the bore has an inner surface, an open end and a closed end;

a piston slidably disposed in the bore of the housing, wherein the piston has a head portion and a connecting rod portion, wherein the head portion has a first and a second apply surface area and the connecting rod portion extends through the open end of the bore of the housing;

a piston liner slidably disposed in the bore of the housing between the housing and the head portion of the piston, wherein the piston liner has a bore, a first and a second end, an inner and an outer surface and a liner apply surface area;

a seal assembly disposed in the open end of the housing bore, wherein the seal assembly includes a sealing surface, a center bore, and an annular channel, wherein the connecting rod portion is sealingly supported by the sealing surface and the annular channel is in communication with the center bore and the first exhaust passage of the housing;

a first hydraulic fluid chamber, wherein the first hydraulic fluid chamber is defined by at least the inner surface of the bore of the housing and the first apply surface area of the head portion of the piston, wherein the first apply passage communicates with the first hydraulic fluid chamber;

a second hydraulic fluid chamber, wherein the second hydraulic fluid chamber is defined by at least the inner surface of the bore of the housing, the liner apply surface area of the piston liner, the second apply surface area of the head portion of the piston and the sealing surface of the seal assembly, wherein the second apply passage communicates with the second hydraulic fluid chamber, and wherein the hydraulic passages are selectively pressurized to move the head of the piston into at least three positions, wherein a first position is defined by the head of the piston adjacent the closed end of the bore of the housing, a second position is defined by the head of the piston adjacent the seal assembly, and a third position is defined by the head of the piston disposed approximately midway between the closed end of the bore of the housing and the seal assembly.

2. The piston actuator assembly of claim 1 wherein the seal assembly further includes a first and a second seal, wherein the first seal has an inner cavity and the second seal is disposed in the inner cavity of the first seal.

3. The piston actuator assembly of claim 1 further including an annular channel defined by the inner surface of the bore of the housing and the outer surface of the piston liner, wherein the annular channel is in communication with the second exhaust passage of the housing.

4. The piston actuator assembly of claim 1 further including a bushing disposed proximate the open end of the bore of the housing.

5. The piston actuator assembly of claim 1 wherein the seal assembly further includes a first connecting rod seal disposed on the inner diameter of the cylinder of the seal assembly.

6. The piston actuator assembly of claim 5 wherein the seal assembly further includes a second connecting rod seal disposed on the inner diameter of the cylinder of the seal assembly.

7. The piston actuator assembly of claim 1 wherein:

the piston further includes a center bore and a piston pin wherein the center bore of the piston has an open end at the second apply surface area of the head portion of the piston;

the piston liner further includes a center guide wherein the center guide has a pair of slots and is attached to the second end of the piston liner and extends into the center bore of the head portion of the piston, and wherein the piston pin is disposed in the head portion of the piston and passes through the pair of slots of the center guide slidably securing the piston to the center guide of the piston liner.

8. The piston actuator assembly of claim 7 wherein the bore of the housing further includes a bore liner having a first end and an outer surface, wherein the first end of the bore liner is in contact with the seal surface of the seal assembly and the outer surface of the bore liner is in contact with the inner surface of the housing bore.

9. The piston actuator assembly of claim 1 wherein the piston liner further includes a first and a second seal groove and a first and a second ring seal, and wherein the first seal groove is disposed in the outer surface of the piston liner proximate to the first end, the second seal groove is disposed in the outer surface of the piston liner proximate to the second end, the first ring seal is disposed in the first seal groove and the second ring seal is disposed in the second seal groove.

10. The piston actuator assembly of claim 9 wherein the piston liner further includes a retainer groove and a ring retainer, wherein the retainer groove is disposed on the inner surface of the piston liner proximate to the first end and the ring retainer is disposed in the groove.

11. The piston actuator assembly of claim 10 wherein the piston liner further includes an exhaust fluid passage disposed between the first and the second seal groove connecting the inner surface and the outer surface of the piston liner.

12. The piston actuator assembly of claim 1 wherein the piston liner further includes a rim, a retainer groove and a ring retainer, wherein the rim is disposed on the inner surface of the piston liner proximate to the first end and the retainer groove is disposed on the inner surface of the piston liner proximate to the second end and the ring retainer is disposed in the retainer groove.

13. The piston actuator assembly of claim 1 wherein the piston liner further includes a retainer groove and a ring retainer, wherein the retainer groove is disposed on the inner surface of the piston liner proximate to the second end and the ring retainer is disposed in the retainer groove.

14. The piston actuator assembly of claim 1 wherein the piston head further includes an outer surface, a seal groove and a ring seal, wherein the seal groove is disposed on the outer surface and the ring seal is disposed in the seal groove.

15. A piston actuator assembly comprising:

a housing having a bore, a first and a second apply passage and a first and a second exhaust passage, wherein the bore has an inner surface, an open end and a closed end;

a piston slidably disposed in the bore of the housing, wherein the piston has a head portion and a connecting rod portion, wherein the head portion has a first and a second apply surface area and the connecting rod portion extends through the open end of the bore of the housing;

a piston liner slidably disposed in the bore of the housing between the housing and the head portion of the piston, wherein the piston liner has a bore, a first and a second end, an inner and an outer surface and a liner apply surface area;

a seal assembly disposed in the open end of the bore of the housing, wherein the seal assembly includes a first and a second seal, a center bore, an annular channel and a sealing surface, wherein the connecting rod portion of the piston is sealingly supported by the sealing surface, the first seal has an inner cavity, an inside surface and the second seal is disposed in the inner cavity of the first seal, and the annular channel is in communication with the center bore and the first fluid exhaust passage of the housing;

an annular channel defined by the inner surface of the bore of the housing and the outer surface of the piston liner, wherein the annular channel is in communication with the second fluid exhaust passage of the housing;

a first hydraulic fluid chamber, wherein the first hydraulic fluid chamber is defined by at least the inner surface of the bore of the housing and the first apply surface area of the head portion of the piston, wherein the first apply passage communicates with the first hydraulic fluid chamber;

a second hydraulic fluid chamber, wherein the second hydraulic fluid chamber is defined by at least the inner surface of the bore of the housing, the liner apply surface area of the piston liner, the second apply surface area of the head portion of the piston and the sealing surface of the seal assembly, wherein the second apply passage communicates with the second hydraulic fluid chamber, and wherein the hydraulic passages are selectively pressurized to move the head of the piston into at least three positions, wherein a first position is defined by the head of the piston adjacent the closed end of the bore of the housing, a second position is defined by the head of the piston adjacent the seal assembly, and a third position is defined by the head of the piston disposed approximately midway between the closed end of the bore of the housing and the seal assembly.

16. The piston actuator assembly of claim 15 wherein:

the bore of the housing further includes a bore liner having a first end and an outer surface, wherein the first end is in contact with the seal surface of the seal assembly and the outer surface is in contact with the inner surface of the housing bore;

the piston further includes a center bore and a piston pin wherein the center bore of the piston has an open end at the second apply surface area of the head portion of the piston;

the piston liner further includes a center guide wherein the center guide has a pair of slots and is attached to the second end of the piston liner and extends into the center bore of the head portion of the piston, and wherein the piston pin is disposed in the head portion of the piston and passes through the pair of slots of the center guide slidably securing the piston to the center guide of the piston liner.

17. The piston actuator assembly of claim 15 wherein the piston liner further includes a retainer groove, a ring retainer, a first and a second seal groove and a first and a second ring seal, wherein the retainer groove is disposed on the inner surface proximate to the first end of the piston liner, the ring retainer is disposed in the retainer groove, the first seal groove is disposed in the outer surface proximate to the first end of the piston liner, the second seal groove is disposed in the outer surface proximate to the second end of the piston liner, the first ring seal is disposed in the first seal groove and the second ring seal is disposed in the second seal groove.

18. The piston actuator assembly of claim 15 wherein the piston liner further includes an exhaust passage disposed between the first and the second seal groove connecting the inner surface and the outer surface.

19. The piston actuator assembly of claim 15 wherein:

the piston liner further includes a rim, a retainer groove and a ring retainer, wherein the rim is disposed on the inner surface proximate to the first end of the piston liner, the retainer groove is disposed on the inner surface of the piston liner proximate to the second end of the piston liner and the ring retainer is disposed in the groove, and the piston head further includes an outer surface, a seal groove and a ring seal, wherein the seal groove is disposed on the outer surface the ring seal is disposed in the seal groove.

20. A piston actuator assembly comprising:

a housing having a bore, a first and a second apply passage and a first and a second exhaust passage, wherein the bore has an inner surface, an open end and a closed end;

a piston slidably disposed in the bore of the housing, wherein the piston has a head portion and a connecting rod portion, wherein the head portion has a first and a second apply surface area and the connecting rod portion extends through the open end of the bore of the housing;

a piston liner slidably disposed in the bore of the housing between the housing and the head portion of the piston, wherein the piston liner has a bore, a retainer groove, a ring retainer, a first and a second end, an inner and an outer surface and a liner apply surface area, wherein the retainer groove is dispose on the outer surface proximate to the second end of the piston liner and the ring retainer is disposed in the retainer groove;

a seal assembly disposed in the open end of the bore of the housing, wherein the seal assembly includes a first and a second seal, a center bore, an annular channel and a sealing surface, wherein the connecting rod portion of the piston is sealingly supported by the sealing surface, the first seal has an inner cavity, an inside surface and the second seal is disposed in the inner cavity of the first seal, and the annular channel is in communication with the center bore and the first fluid exhaust passage of the housing;

an annular channel defined by the inner surface of the bore of the housing and the outer surface of the piston liner, wherein the annular channel is in communication with the second fluid exhaust passage of the housing;

a first hydraulic fluid chamber, wherein the first hydraulic fluid chamber is defined by at least the inner surface of the bore of the housing and the first apply surface area of the head portion of the piston, wherein the first apply passage communicates with the first hydraulic fluid chamber;

a second hydraulic fluid chamber, wherein the second hydraulic fluid chamber is defined by at least the inner surface of the bore of the housing, the liner apply surface area of the piston liner, the second apply surface area of the head portion of the piston and the sealing surface of the seal assembly, wherein the second apply passage communicates with the second hydraulic fluid chamber;

wherein the hydraulic passages are selectively pressurized to move the head of the piston into at least three positions, wherein a first position is defined by the head of the piston adjacent the closed end of the bore of the housing, a second position is defined by the head of the piston adjacent the seal assembly, and a third position is defined by the head of the piston disposed approximately midway between the closed end of the bore of the housing and the seal assembly.

* * * * *